US006244736B1

(12) United States Patent
O'Neal

(10) Patent No.: US 6,244,736 B1
(45) Date of Patent: Jun. 12, 2001

(54) THEFT RESISTANT LAMP ASSEMBLY MOUNTING BRACKET

(75) Inventor: Charles P. O'Neal, Madison, IN (US)

(73) Assignee: Grote Industries, Inc., Madison, IN (US)

( * ) Notice: Subject to any disclaimer, the term of this patent is extended or adjusted under 35 U.S.C. 154(b) by 0 days.

(21) Appl. No.: 09/276,606

(22) Filed: Mar. 25, 1999

(51) Int. Cl.[7] ..... F21V 7/04

(52) U.S. Cl. ..... 362/549; 362/368; 362/370; 362/378; 362/485

(58) Field of Search ..... 362/368, 370, 362/378, 549, 485

(56) References Cited

U.S. PATENT DOCUMENTS 4,507,718 * 3/1985 Bury ..... 362/396
5,193,643 * 3/1993 McItyre ..... 180/312
5,730,522 * 3/1998 Wyke ..... 362/432

* cited by examiner

*Primary Examiner*—Sandra O'Shea
*Assistant Examiner*—Ali Alavi
(74) *Attorney, Agent, or Firm*—Woodard, Emhardt, Naughton, Moriarty & McNett

(57) ABSTRACT

The present invention comprises a mounting bracket that may be permanently mounted to a vehicle, such as by riveting. The mounting bracket includes at least one deflectable tab that is deflected away from a main plane of the bracket when the lamp assembly is pressed against it. The lamp assembly includes an extending surface which interacts with the mounting bracket tab in order to deflect the tab. Subsequent rotation of the lamp assembly in a clockwise direction causes the lamp extending surface to move under the mounting bracket, allowing the deflected tab to return to its quiescent position Any attempt to remove the lamp assembly from the mounting bracket by turning the lamp assembly in a counter-clockwise direction is prevented by interaction between the lamp extending surface and the now non-deflected mounting bracket tab. Theft of the lamp assembly is thereby prevented.

16 Claims, 5 Drawing Sheets

THEFT RESISTANT LAMP ASSEMBLY MOUNTING BRACKET

TECHNICAL FIELD OF THE INVENTION

The present invention generally relates to vehicle lamp assemblies and, more particularly, to a theft resistant lamp assembly mounting bracket.

BACKGROUND OF THE INVENTION

Vehicles, particularly trucks, utilize many replaceable lamps, such as sidemarker lamps which are installed on the sides of trucks and trailers in order to clearly mark the boundaries of the truck and trailer at night. Because these lamps must be replaced on a regular basis when their lamp elements fail, typical prior art lamps are formed as a unit assembly with a case and lens (usually of plastic), and mount to a bracket permanently affixed to the vehicle. Rotation of the lamp assembly upon the bracket in a clockwise manner serves to affix the lamp assembly to the bracket, while rotation of the lamp assembly in a counter-clockwise direction allows the lamp assembly to be completely removed from the bracket.

While it is important for the lamp assembly to be removable from the bracket to allow for servicing of failed lamps, such removability also allows for relatively easy theft of the lamp assemblies. Such theft has become a greater concern with the introduction of lamp assemblies utilizing light emitting diodes (LEDs) as the illumination elements, as these lamp assemblies are substantially more expensive. Not only does this expense increase the loss associated with the theft of a lamp assembly, but it also presents an increased incentive for theft.

There is therefore a need for a vehicle lamp and mounting bracket that is theft resistant. The present invention is directed toward meeting this need.

SUMMARY OF THE INVENTION

The present invention comprises a mounting bracket that may be permanently mounted to a vehicle, such as by riveting. The mounting bracket includes at least one deflectable tab that is deflected away from a main plane of the bracket when the lamp assembly is pressed against it. The lamp assembly includes an extending surface which interacts with the mounting bracket tab in order to deflect the tab. Subsequent rotation of the lamp assembly in a clockwise direction causes the lamp extending surface to move under the mounting bracket, allowing the deflected tab to return to its quiescent position. Any attempt to remove the lamp assembly from the mounting bracket by turning the lamp assembly in a counter-clockwise direction is prevented by interaction between the lamp extending surface and the now non-deflected mounting bracket tab. Theft of the lamp assembly is thereby prevented.

A theft resistant lamp assembly mounting bracket is disclosed, comprising a mounting surface adapted to mount the bracket to a vehicle; a first flange coupled to the mounting surface, the flange defining an opening therethrough; and at least one deflectable tab formed into the first flange and having a quiescent position wherein application of a force to the tab causes it to deflect away from the quiescent position and removal of the force allows the tab to substantially return to its quiescent position.

A theft resistant lamp assembly and mounting bracket therefor, in combination, are disclosed comprising a mounting bracket, comprising a mounting surface adapted to mount the bracket to a vehicle; a first flange coupled to the mounting surface, the flange defining an opening therethrough; and at least one deflectable tab formed into the first flange and having a quiescent position wherein application of a force to the tab causes it to deflect away from the quiescent position and removal of the force allows the tab to substantially return to its quiescent position; and a lamp assembly, comprising an illumination element; a base adapted to carry the illumination element; at least one surface extending away from the base; wherein the at least one extending surface aligns with the at least one tab when the lamp assembly is placed upon the mounting bracket, such that pressing the lamp assembly against the mounting bracket deflects the at least one tab away from the quiescent position, whereupon rotation of the lamp assembly with respect to the mounting bracket moves the at least one extending surface under the first flange, thereby allowing the at least one tab to return to the quiescent position.

DETAILED DESCRIPTION OF THE PREFERRED EMBODIMENT

Figure 1B:
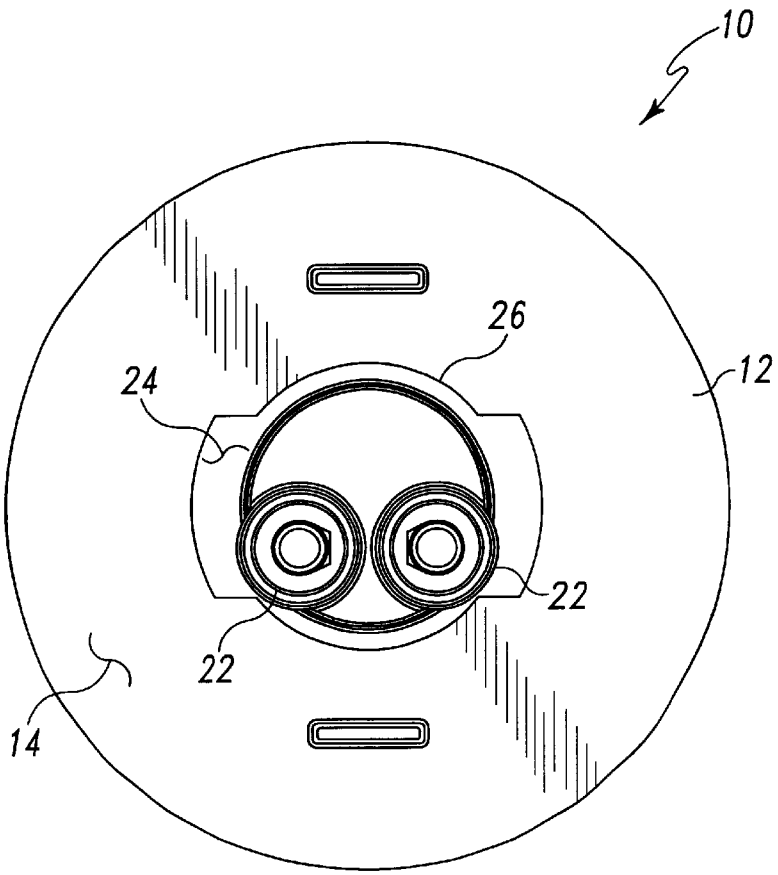
FIG. 1B is a bottom plan view of the lamp assembly of FIG. 1A.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

As discussed hereinabove, many lamp assemblies are now utilizing LEDs as the illumination element. Because LEDs have an expected life that is longer than that of the vehicle to which they are attached, there is no need to provide for the removability of these lamp assemblies once they are installed on the vehicle. The present invention therefore provides a lamp assembly mounting bracket which does not allow the lamp assembly to be removed from the mounting bracket after the lamp assembly has been mounted thereon. Such a bracket makes it nearly impossible to steal the lamp assembly off of the vehicle.

Figure 1A:
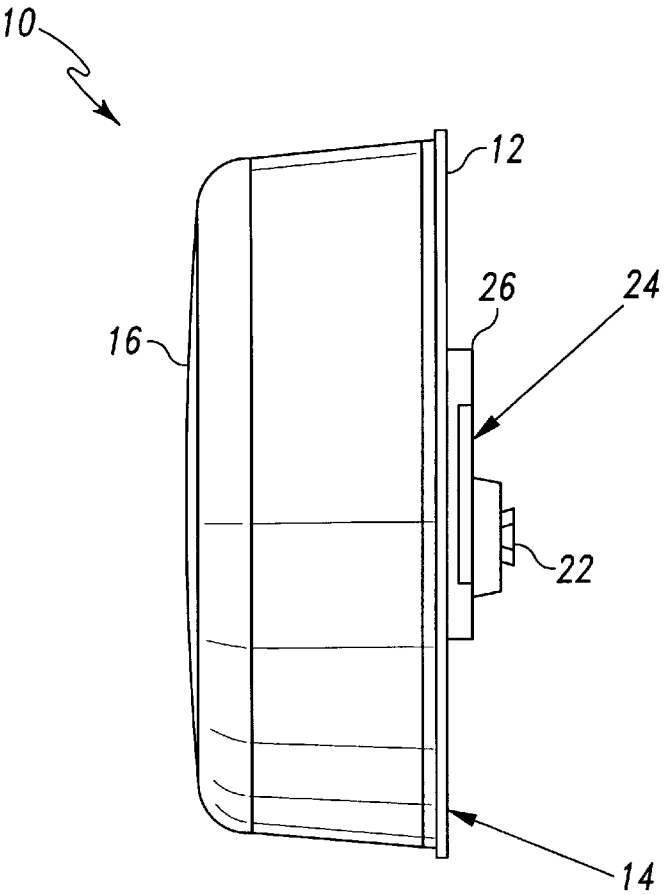
FIG. 1A is a side-elevational view of a lamp assembly of the present invention.

FIGS. 1A–B illustrate two views of a prior art vehicle side marker lamp assembly manufactured by Grote Industries, Inc. of Madison, Ind., and indicated generally at 10. The lamp assembly 10 includes a substantially flat base 12 having a base surface 14. A lens 16 is mounted to the base 12. Mounted to the base 12 below the lens 16 is a printed circuit board 18 carrying a plurality of LEDs 20 (see FIGS.

4–5). Electrical energy is provided to the circuit board 18 by means of a pair of terminals 22. The base 12 includes two extending surfaces 24 which lie in a plane substantially parallel to the surface 14 and spaced therefrom. In a preferred embodiment, there are two such extending surfaces 24 extending from a central elevated island 26 of the base 12 and spaced 180° apart, although other configurations for the extending surfaces 24 will be readily apparent to those having ordinary skill in the art, such as surfaces which extend from other portions of the base 12, either near the circumferential edge of the base 12 or at a point between the center of the base 12 and its circumferential edge.

Figure 2:
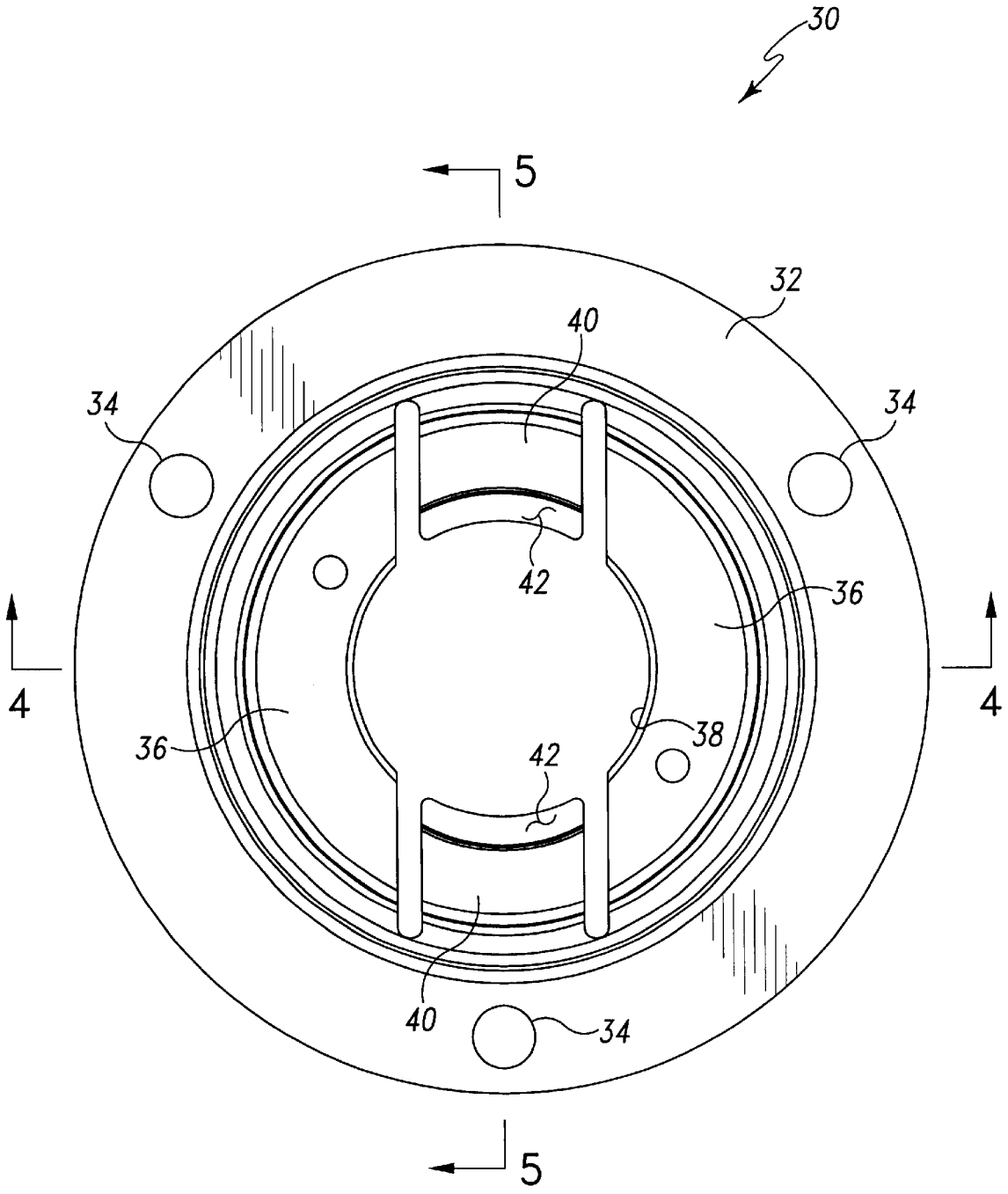
FIG. 2 is a top plan view of a lamp mounting bracket of the present invention.
Figure 3:
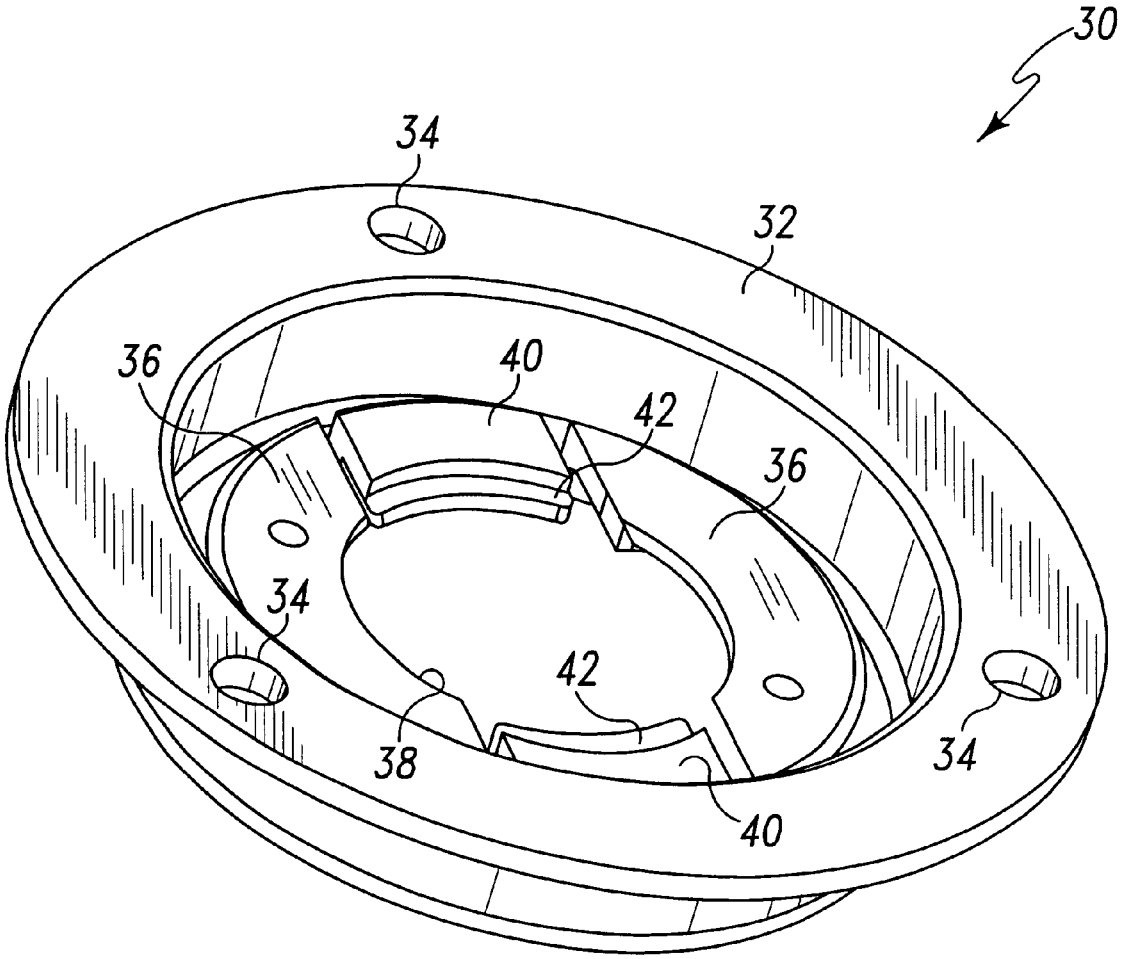
FIG. 3 is a perspective view of the lamp mounting bracket of FIG. 2.

Referring now to FIGS. 2 and 3, there is shown a preferred embodiment lamp assembly mounting bracket of the present invention, indicated generally at 30. The bracket 30 includes a circumferential flange 32 having mounting holes 34 formed therein The mounting holes 34 may be used to mount the mounting bracket to the vehicle, preferably with stainless steel rivets. The bracket 30 also has an inner flange 36 that defines an inner opening 38 therethrough. The island 26 of the lamp assembly 10 is sized so that it fits through the opening 38. The inner flange 36 further includes a pair of deflectable tabs 40 that may be deflected downwardly away from the flanges 32 and 36 by applying appropriate pressure to the tabs 40. Upon release of this downward pressure, the deflectable tabs 40 return to their quiescent, non-deflected position.

As best seen with reference to FIGS. 2–5, the tabs 40 include a circumferential depression 42 on their top sides (the top of the mounting bracket 30 being defined by the flange 32). The remainder of the flange 36 has a circumferential depression 43 on its bottom side. The mounting bracket 30 may be formed from any convenient material, such as steel, aluminum, plastic, or any other material strong enough and resilient enough to allow the mounting bracket 30 to function as described herein. Those having ordinary skill in the art will recognize that a wide variety of materials may be used.

In operation, the lamp assembly 10 is mounted to the mounting bracket 30 by aligning the extending surfaces 24 with the tabs 40 and positioning the island 26 within the opening 38. In this position, the extending surfaces 24 lie within the depressions 42. Applying pressure to the lamp assembly 10 toward the mounting bracket 30 will cause the tabs 40 to deflect downwardly. Once the tabs 40 have been deflected downwardly, the lamp assembly 10 may be turned in a clockwise direction in order to position the extending surfaces 24 underneath the non-deflecting portion of the inner flange 36. Once the extending surfaces 24 have been moved clear of the tabs 40, their resilient nature will cause them to return to their quiescent, non-deflected position. The complementary nature of the depressions 42 and 43 facilitate transitioning of the extending surfaces 24 from on top of the tabs 40 to underneath the non-deflecting portion of the flange 36.

Figure 4:
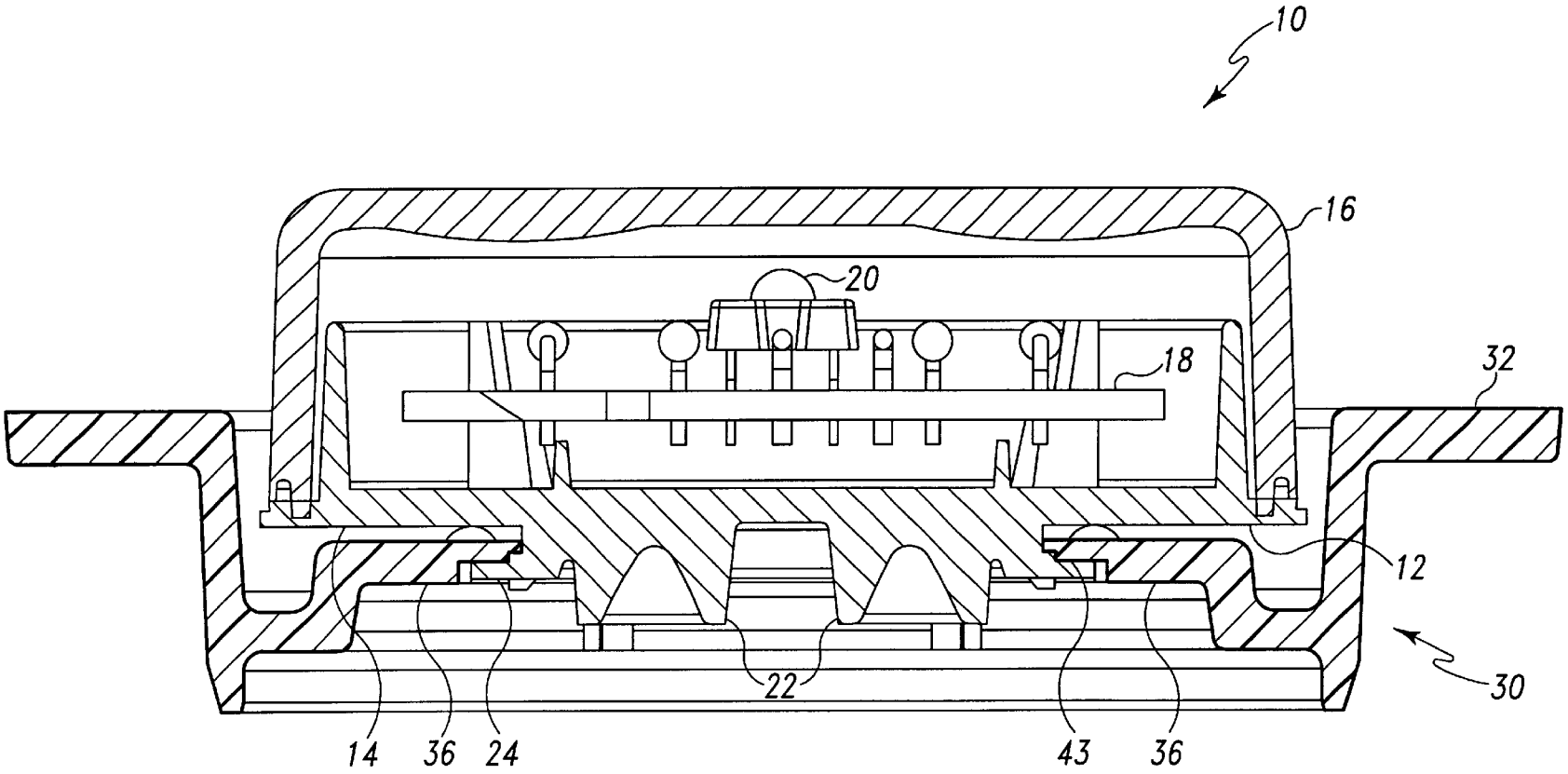
FIG. 4 is a first cross-sectional view of the lamp assembly of FIGS. 1A–B mounted to the mounting bracket of FIGS. 2–3.
Figure 5:
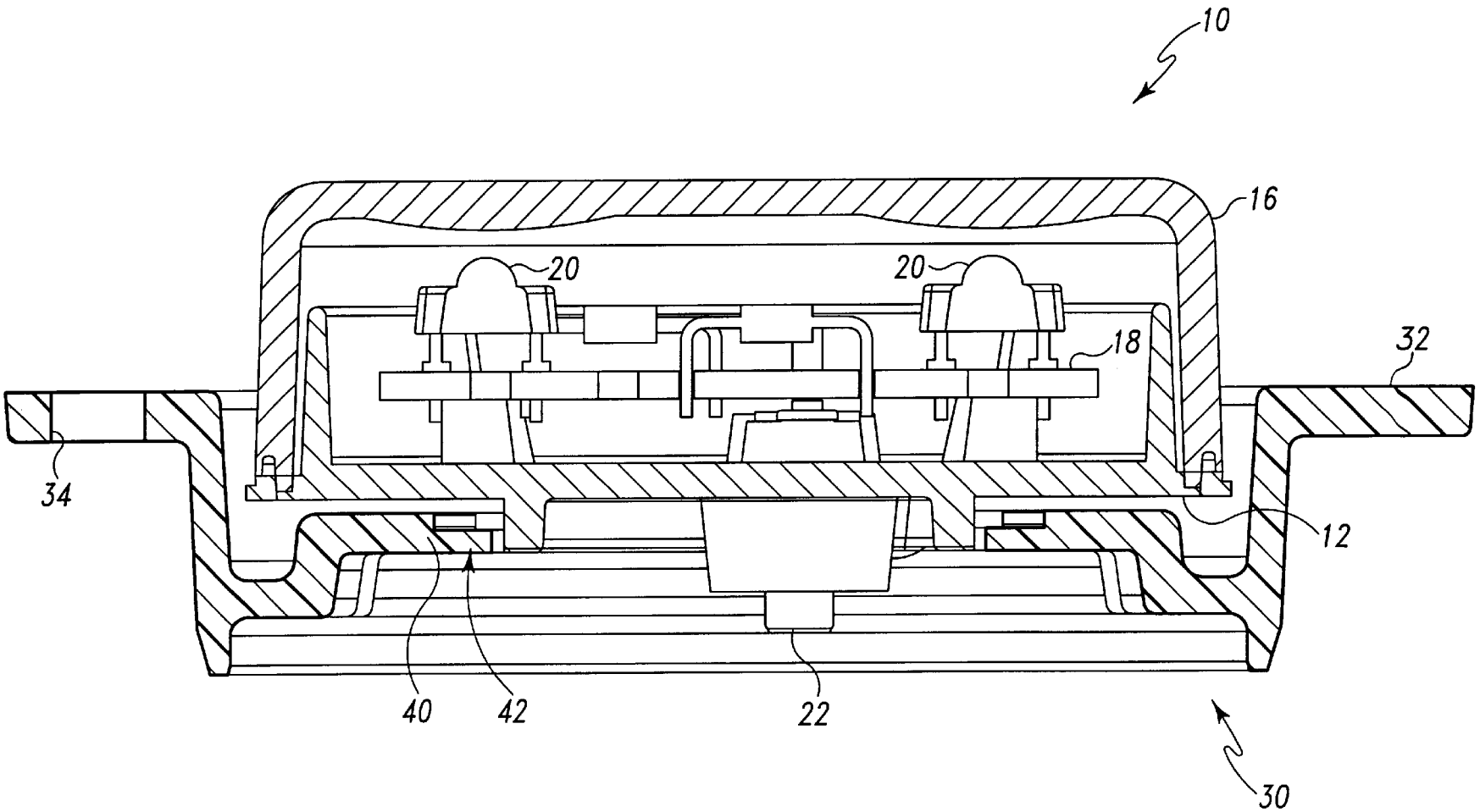
FIG. 5 is a second cross-sectional view of the lamp assembly of FIGS. 1A–B mounted to the mounting bracket of FIGS. 2–3.

Once in this position, the lamp assembly 10 has been permanently captured by the mounting bracket. Any attempt to remove the lamp assembly 10 by turning the lamp assembly 10 in a clockwise direction will cause the extending surfaces 24 to abut against the depression 42 of the tab 40. Interference between the extending surfaces 24 and the depression 42 prevents further counter-clockwise rotation of the lamp assembly 10. The lamp assembly 10 is therefore permanently captured within the mounting bracket 30. FIGS. 4 and 5 illustrate the lamp assembly 10 mounted to the mounting bracket 30.

The mounting bracket 30 of the present invention therefore provides a theft resistant mounting for a vehicle lamp assembly. If a person were to try to remove a lamp assembly 10 from the bracket 30 by rotating the lamp assembly 10 in a counter-clockwise direction, interference between the extending surfaces 24 and the lowered portions 42 of the mounting bracket 30 keep the lamp assembly 10 in its installed position. If the entire bracket 30 is installed onto the vehicle using stainless steel rivets, the would-be thief would have to drill out the rivets, remove the bracket 30 and lamp assembly 10 and break the bracket 30 in order to remove the lamp assembly 10. The difficulty of this operation is likely to deter theft of the lamp assembly 10.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A theft resistant lamp assembly mounting bracket, comprising:

a mounting surface adapted to mount the bracket to a vehicle;

a first flange coupled to the mounting surface, the flange defining a circular opening therethrough;

at least one deflectable tab formed into the first flange and having a quiescent position;

a first circumferential depression formed on the first flange;

a second circumferential depression formed on the at least one tab;

wherein the first circumferential depression is formed in an opposite direction from the second circumferential depression; and wherein application of a force to the tab causes it to deflect away from the quiescent position and removal of the force allows the tab to substantially return to its quiescent position.

2. The mounting bracket of claim 1, wherein the mounting surface comprises a second flange.

3. The mounting bracket of claim 2, wherein the first flange lies substantially in a first plane and the second flange lies substantially in a second plane, the first and second planes being non-coextensive.

4. The mounting bracket of claim 1, further comprising a plurality of holes formed in the mounting surface.

5. The mounting bracket of claim 1, wherein the vehicle comprises a truck.

6. The mounting bracket of claim 1, wherein the vehicle comprises a trailer.

7. The mounting bracket of claim 1, wherein the at least one tab comprises two tabs spaced substantially 180° apart on the first flange.

8. A theft resistant lamp assembly and mounting bracket therefor, in combination, comprising:

a mounting bracket, comprising:

a mounting surface adapted to mount the bracket to a vehicle;

a first flange coupled to the mounting surface, the flange defining an opening therethrough; and at least one deflectable tab formed into the first flange and having a quiescent position;

wherein application of a force to the tab causes it to deflect away from the quiescent position and removal of the force allows the tab to substantially return to its quiescent position; and a lamp assembly, comprising:

an illumination element;

a base adapted to carry the illumination element;

at least one surface extending away from the base;

wherein the at least one extending surface aligns with the at least one tab when the lamp assembly is placed upon the mounting bracket, such that pressing the lamp assembly against the mounting bracket deflects the at least one tab away from the quiescent position, whereupon rotation of the lamp assembly with respect to the mounting bracket moves the at least one extending surface under the first flange, thereby allowing the at least one tab to return to the quiescent position.

9. The combination of claim 8, wherein the mounting surface comprises a second flange.

10. The combination of claim 9, wherein the first flange lies substantially in a first plane and the second flange lies substantially in a second plane, the first and second planes being non-coextensive.

11. The combination of claim 8, further comprising a plurality of holes formed in the mounting surface.

12. The combination of claim 8, wherein the vehicle comprises a truck.

13. The combination of claim 8, wherein the vehicle comprises a trailer.

14. The combination of claim 8, wherein the opening is circular.

15. The combination of claim 8, wherein the at least one tab comprises two spaced substantially 180° apart on the first flange.

16. The combination of claim 14, further comprising:

a first circumferential depression formed on the first flange; and a second circumferential depression formed on the at least one tab;

wherein the first circumferential depression is formed in an opposite direction the second circumferential depression.

* * * * *

UNITED STATES PATENT AND TRADEMARK OFFICE

CERTIFICATE OF CORRECTION

PATENT NO. : 6,244,736 B1
DATED : June 12, 2001
INVENTOR(S) : O'Neal et al.

It is certified that error appears in the above-identified patent and that said Letters Patent is hereby corrected as shown below:

Column 6,
Line 8, between the words "two" and "spaced", please insert -- tabs --.

Signed and Sealed this

Eleventh Day of June, 2002

*Attest:*

*Attesting Officer*

JAMES E. ROGAN
*Director of the United States Patent and Trademark Office*